US007695882B2

(12) United States Patent
Broce et al.

(10) Patent No.: US 7,695,882 B2
(45) Date of Patent: Apr. 13, 2010

(54) TONER FORMULATION FOR CONTROLLING MASS FLOW

(75) Inventors: Scott Moreland Broce, Longmont, CO (US); Robert Joseph Firmature, Thornton, CO (US); Yueping Fu, Longmont, CO (US); Matthew David Heid, Simpsonville, KY (US); Lance Tisdale Hoshiko, Longmont, CO (US); James Craig Minor, Longmont, CO (US); Karen Eileen Zrebiec, Lafayette, CO (US)

(73) Assignee: Lexmark International, Inc., Lexington, KY (US)

( * ) Notice: Subject to any disclaimer, the term of this patent is extended or adjusted under 35 U.S.C. 154(b) by 481 days.

(21) Appl. No.: 11/670,076

(22) Filed: Feb. 1, 2007

(65) Prior Publication Data

US 2008/0187856 A1 Aug. 7, 2008

(51) Int. Cl.
*G03G 9/00* (2006.01)

(52) U.S. Cl. ..... 430/108.6; 430/108.7; 430/111.4

(58) Field of Classification Search ..... 430/108.6, 430/108.7, 111.4
See application file for complete search history.

(56) References Cited

U.S. PATENT DOCUMENTS

| | | | | |
|---|---|---|---|---|
| 5,332,639 | A * | 7/1994 | Nakamura et al. | 430/108.6 |
| 5,945,245 | A | 8/1999 | Mychajlowskij et al. | |
| 5,992,501 | A | 11/1999 | El Gammal et al. | |
| 5,994,020 | A | 11/1999 | Patel et al. | |
| 6,132,924 | A | 10/2000 | Patel et al. | |
| 6,268,102 | B1 | 7/2001 | Hopper et al. | |
| 6,492,083 | B1 | 12/2002 | Livengood et al. | |
| 6,531,254 | B1 | 3/2003 | Bedells et al. | |
| 6,531,256 | B1 | 3/2003 | Bedells et al. | |
| 6,534,230 | B1 | 3/2003 | Blair et al. | |
| 6,703,175 | B2 * | 3/2004 | Ebisu et al. | 430/108.6 |
| 6,962,764 | B2 | 11/2005 | Vanbesien et al. | |
| 6,982,139 | B2 | 1/2006 | Horikoshi et al. | |
| 2002/0021913 | A1 * | 2/2002 | Nakamura et al. | 399/66 |
| 2004/0170913 | A1 * | 9/2004 | Lee et al. | 430/108.6 |
| 2005/0129428 | A1 * | 6/2005 | Nagatomo et al. | 399/175 |
| 2006/0220500 | A1 | 10/2006 | Shimada et al. | |

* cited by examiner

*Primary Examiner*—Mark A Chapman
(74) *Attorney, Agent, or Firm*—Steven J. Grossman

(57) ABSTRACT

The present invention relates to controlling the mass flow of toner in an image forming device or a toner cartridge. The toner composition includes extra particulate additives including a conductive additive. The extra particulate additives may also include relatively small silica particles or relatively large silica.

24 Claims, 8 Drawing Sheets

TONER FORMULATION FOR CONTROLLING MASS FLOW

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present disclosure relates generally extra particulate additive packages for toner that provides improved or reduced mass flow. In particular, the present disclosure relates to the use of extra particulate additives, such as conductive additives in combination with other particles to improve the mass flow in a toner supply.

2. Description of the Related Art

Generally, relatively high resolution printing may be obtained by reducing toner particle size. However, as the particle size of a given toner decreases, the ability to control the mass flow within a given range or operating window degrades. In particular, the mass flow may increase, causing various print defects. Accordingly, one may improve control over mass flow, i.e. reduce the mass flow and/or maintain the mass flow within a given range, by either altering the toner supply components or by altering the toner formulation.

SUMMARY OF THE INVENTION

An aspect of the present disclosure relates to a toner composition that may include toner particles having a size of about 1-25 μm and silica particles having an average diameter $D_1$ and an average diameter $D_2$ wherein $D_1<D_2$. The composition may also include conductive additive having a volume resistivity in the range of about $E^{-6}$ to $E^{6}$ ohm-cm, which may be present at a concentration in the toner composition to provide a mass flow of about 0.2 to 1.5 mg/cm$^2$.

Another aspect of the present disclosure relates to a method for controlling the mass flow of a toner having a particle size of about 1-25 μm. The method may include mixing a toner with a conductive additive, wherein the conductive additive may have a volume resistivity in the range of about $E^{-6}$ to $E^{6}$ ohm-cm and may be combined with the toner at a concentration to provide a mass flow of about 0.2 to 1.5 mg/cm$^2$.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
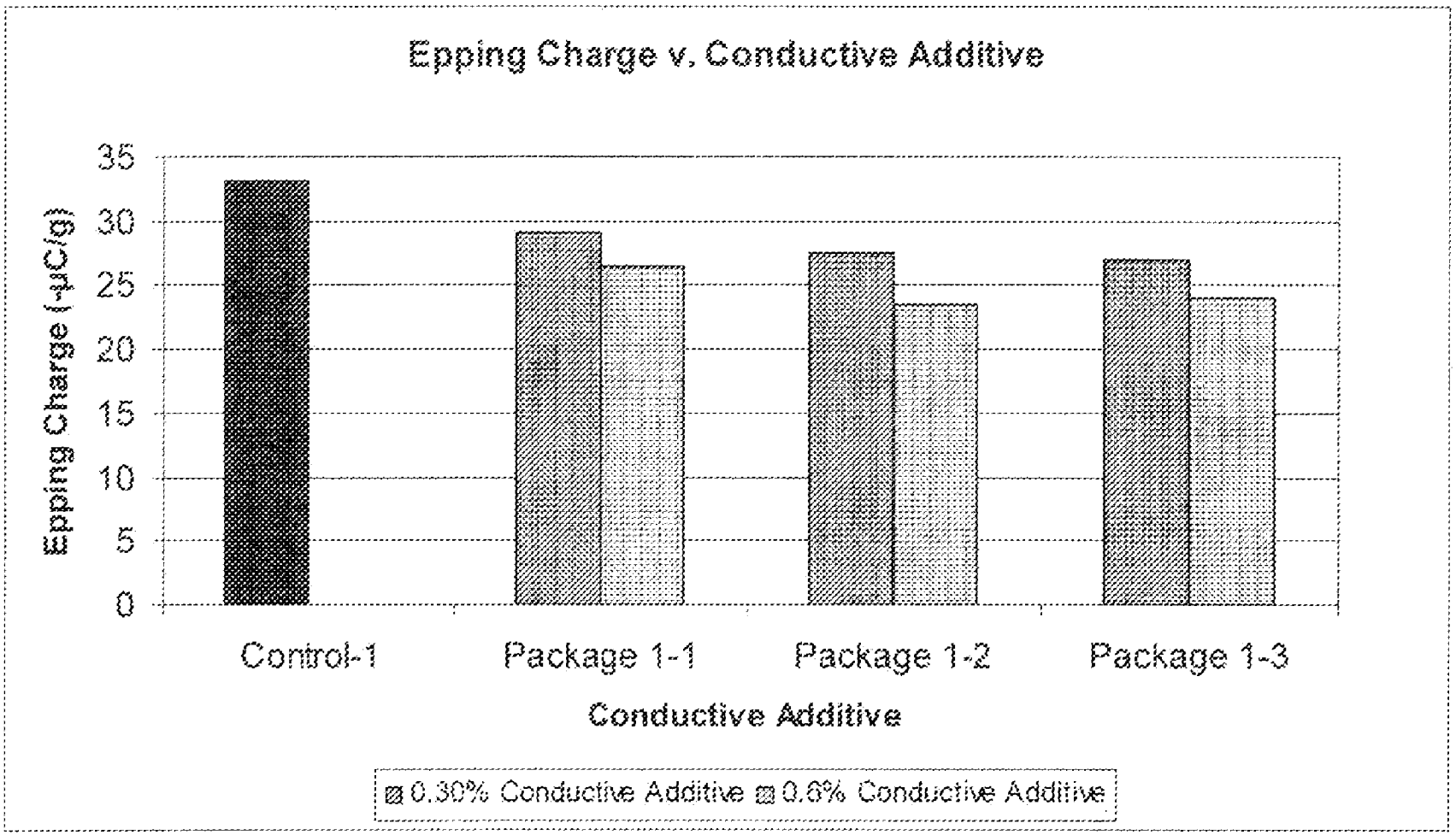
FIG. 1 illustrates the effect of the addition of various conductive additives on the Epping charge of a toner.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Toner may include resin, pigments, and various additives, such as wax and charge control agents. The toner may be formulated by conventional practices (e.g. melt processing and grinding or milling) or by chemical processes (i.e. suspension polymerization, emulsion polymerization or aggregation processes.) In addition, the toner may have an average particle size in the range of about 1 to 25 μm, including all values and increments therein.

The toner may also include extra particulate additives. The extra particulate additives may be formulated from organic or inorganic particles, such as metal oxides including, silica, titania, alumina, zirconia, ceria, strontium titanate, etc. These particles may be surface treated with various agents, such as additional metal oxides, hydrophobicity enhancers, positive or negative charge enhancers, etc. Many of these additives may be insulative, having a volume resistivity in the range of $E^{7}$ to $E^{16}$ ohm-cm.

However, conductive additives may be used as an extra particulate additive. A conductive additive may be defined as semiconductive material, having a volume resistivity in the range of $E^{-1}$ ($\mathbf{10^{-1}}$) to $E^{6}$ ($\mathbf{10^{6}}$) ohm-cm, or conductive material having a volume resistivity in the range of $E^{-6}$ to $E^{-1}$ ohm-cm. Accordingly, conductive additives herein contemplates any material having a volume resistivity having a value of $E^{-6}$ to $E^{6}$, including all values and increments therein.

The conductive additives may be present in the form of particles wherein a conductive or semiconductive material itself forms the particle. The conductive material may therefore include antimony doped tin oxide, antimony doped indium oxide, antimony doped indium-tin oxide, zinc oxide with or without metal doping, carbon black and selected metal oxides, etc.

In addition, the conductive additives may include an insulative particle that may be coated or otherwise doped with a semiconductive or conductive material. For example, the conductive additive may utilize a relatively nonconductive or semi-conductive silica, alumina, titania, zinc oxide, etc. which may then be coated with inorganic or organic conductive substances. Such coating substances may include poor metal oxides such as antimony oxide, tin oxide, etc. As defined herein, poor metals may include, for example, gallium, indium, thallium, germanium, tin, lead, antimony, bismuth, polonium or combinations thereof. The conductive coatings may therefore specifically include antimony doped tin oxide, antimony doped indium oxide, antimony doped indium-tin oxide, etc. Further conductive coatings may include organic conductive compounds or polymers such as polyanilines, polypyrroles, polythiophenes, etc.

The above referenced conductive additives may have a particle size in the range of about 5 nm to 2,000 nm, including all values and increments therein. In addition, the conductive additives may have various geometries and may be, for example, substantially spherical, acicular, flake, or a combination of geometries. By substantially spherical it may be understood to have a degree of circularity of greater than or equal to about 0.90.

Particular exemplary conductive additives may include $Sb_2O_5$ doped $SnO_2$ coated titania, having a particle size in the range of 10 to 400 nm, including all values and increments therein. In addition the additives may have a specific surface area in the range of 1-60 $m^2/g$ as measured by the BET method. The coated titania may also be treated with a coupling agent. Such additives may be available from Ishihara Corporation, USA (ISK) under the product numbers ET-300W, ET-600W, ET500W; as well as from Titan KKK under the product number EC-300T. Other exemplary conductive additives may include $Sb_2O_5$ doped $SnO_2$ coated silica, having a particle size in the range of 10 to 300 nm, including all values and increments therein. Such additives may be available from Titan KKK under the product number ES-650. Additional particularly exemplary conductive additives may include $Sb_2O_5$ doped $SnO_2$ coated acicular titania having a particle length in the range of 0.5-10 μm, including all values and increments therein and a diameter of 0.1 to 1.0 μm, including all values and increments therein. Such additives may be available from Ishihara Corporation, USA (ISK) under the product number FT-1000, FTX-09, FTX-10, etc.

In an exemplary embodiment, the extra particulate additives may be formulated into a package containing metal oxide particles, relatively large silica particles, relatively small silica particles and the conductive additives described herein. The metal oxide particles may include transition metals, such as titanium, zinc, etc. The metal oxide particles may also be coated with a second metal oxide, such as aluminum oxide. The metal oxide particles may have a particle diameter in the range of 0.1 to 1.0 μm, including all values and increments therein. In addition, the metal oxide particles may have a particle length in the range of about 0.5 to 10 μm, including all values and increments therein. Furthermore, the particles may have a specific surface area in the range of 1 to 50 $m^2/g$ as measured by the BET method, including all values and increments therein. The metal oxide particles may be available from Ishihara Corporation, USA (ISK) under the FTL series of particles, such as FTL-100, FTL-110, etc.

The relatively small silica may be fumed silica. The relatively small silica may be treated with hexamethyldisilazane (HMDS), which may render the silica more hydrophobic. The relatively small silica particles may have an average primary particle size or diameter $D_1$ in the range of 1 to 50 nm, including all values and increments therein, such as 7 nm. Primary particle size may be understood as the size of the individual particles; as it should be appreciated that the particles may agglomerate. The relatively small silica particles may have a specific surface area in the range of 100 to 300 $m^2/g$, including all values and increments therein. An exemplary fumed silica may be available from Degussa® under the trade name Aerosil®, such as Aerosil® 300, Aerosil® R-812, etc.

The relatively large silica may also be fumed silica. The relatively large silica may have a negative electrostatic charge and may be treated with silicone oil. The relatively large silica particles may have an average primary particle size or diameter $D_2$ in the range of 30 to 80 nm, including all values and increments therein, such as 40 nm. It may therefore be appreciated that $D_2$ may be specified such that $D_2$ is greater than $D_1$. The relatively large silica particles may have a specific surface area in the range of 1 to 100 $m^2/g$, including all values and increments therein, such as 15 to 45 $m^2/g$. An exemplary fumed silica may be available from Degussa® under the trade name Aerosil®, such as Aerosil® OX 50, Aerosil® RY-50, etc.

In exemplary embodiment, the extra particulate package may contain the previously discussed conductive additives which may be present in the toner composition between 0.01 to about 5.0% by weight of the toner, including all increments and values therein. The relatively large silica particles may be present in the package in the range of 0.1 to about 1.5% by weight of the toner, including all increments and values therein. The relatively small silica particles may be present in the package in the range of about 0.1 to about 0.5% by weight of the toner, including all increments and values therein. The acicular titania coated with alumina may be present in the package in the range of about 0.1 to about 0.5% by weight of the toner composition including all increments and values therein.

In addition, in an exemplary embodiment, wherein the conductive additives may be substantially spherical in nature, the small silica particles may be present in the range of about 0.1 to 0.3% by weight of the toner, including all increments and values therein and the alumina coated acicular titania particles may be present in the range of about 0.2 to 0.4% by weight of the toner, including all increments and values therein. In addition, the large silica may be present in the range of about 0.2 to 1.0% by weight of the toner, including all values and increments therein. Furthermore, the conductive additive may be present in the range of about 0.1 to about 0.8% by weight of the toner, including all values and increments therein.

In another exemplary embodiment, wherein the conductive additives may be substantially acicular in nature, the small silica particles may be present in the range of about 0.1 to 0.3% by weight of the toner, including all values and increments therein. The large silica may be present in the range of 0.5 to 1.5% by weight of the toner, including all values and increments therein. In addition, the alumina coated acicular titania may be present in the range of about 0.1 to 0.5% by weight, including all values and increments therein. Furthermore, the conductive additive may be present in the range of about 0.1 to 0.5% by weight of the toner, including all values and increments therein.

The toner particles may be combined with the extra particulate additive packages containing the conductive additive by mixing. For example, the particles and additives may be mixed in a Henschel or Cyclomix mixer for varying time intervals and speeds. In an exemplary embodiment, the particles and additives may be mixed at a first speed for about 1 to 400 seconds and at a second speed for about 50 to 1,000 second. The first speed may be in the range of about 1 to 50 Hz, including all values and increments therein, and the second speed may be in the range of about 10 to 80 Hz, including all values and increments therein. In an exemplary embodiment, the first speed may be chosen such that it is lower than the second speed.

The Epping Charge of the resultant toner may be measured using a combination of a known amount of toner and ca. 100 μm carrier beads. The toner and beads may be mixed and shaken together under a fixed set of conditions, wherein the toner and beads tribocharge each other. After mixing, a preweighed sample of the toner/bead combination may be placed in a Faraday cage with screens on both ends. Air may be drawn into one end of the cage and charged toner may pass with the air stream out of the other end of the cage, while the beads are retained by the screen. After toner removal, the sample may be weighed again to provide a toner mass and an electrometer measures the charge of the carrier beads, which is equal and opposite to the charge of the removed toner. The toner including the extra particulate additive package containing a conductive additive may have an Epping charge in the range of 10 to 30-μC/g, including all increments and values therein.

Toner mass flow is a measurement which provides an indication of the amount of toner in a given area on a roller such as a developer roller in an electrophotographic printer. For example, the mass flow may be measured by loading the developer roll with toner, as during the printing process, and then applying a template over the developer roll having a cut-out of a known area. The toner may be removed from the cut out area by a vacuum that may include a filter assembly. The amount of toner removed from that area may then be measured to determine the amount of toner in the given area of the roller. As described further herein, the use of conductive additive as noted above has been observed to influence the value of toner mass flow. That is, toner including the extra particulate additive package noted above, which incorporates conductive additive, may allow the control of toner mass flow. In a particular embodiment, the mass flow of toner on a developer roller, which has experienced less than about 100 print pages, may be controlled to provide a value within a given operating window or range. Accordingly, the mass flow may be 0.5 to 1.5 mg/cm$^2$ including all increments and ranges therein. For example, the mass flow may be controlled herein on given roller at a given print speeds, via the use of conductive additives, to provide a mass flow of 0.4 to 0.8 mg/cm$^2$ or a mass flow of 0.4 to 0.6 mg/cm$^2$. Again, such values of mass flow may be specifically achieved on a roller with less than 100 print pages.

In addition, the above influence in mass flow may be achieved herein when the conductive additives are present on the surface of the toner. Accordingly, the conductive additives may be added in the indicated concentrations to the toner particles so that they reside substantially on the surface. However, it is contemplated herein that the conductive additives may also be combined within the bulk of the toner. For example, it is contemplated that the conductive additives may be combined with resin, pigments and various additives prior to a step of extrusion and pulverization. It may be appreciated that in such a situation, the above referenced concentration of conductive additive, sufficient to influence mass flow, would necessarily be increased so that an appropriate level of conductive additive also resides on the toner particle surface.

Toner may typically be supplied to media in an image forming device by a toner supply, such as a printer cartridge and/or a developing unit, including the photoconductor. Image forming devices may include printers, copiers, fax machines, all-in-one devices, multi-functional devices, etc. To transfer the toner to the media, the toner supply may utilize charge transfer, wherein the toner may be conveyed by differential charging of the toner and supply components.

The following examples are presented for illustrative purposes only and therefore are not meant to limit the scope of the disclosure and claimed subject matter attached herein.

EXAMPLE 1

A relatively small particle toner having a particle size of approximately 6.5 μm was treated with a number of extra particulate additive packages described below in Table 1, containing relatively spherical conductive additive.

TABLE 1

| Extra Particulate Additive Packages | | | | |
|---|---|---|---|---|
| | EPA (% by weight of the toner) | | | |
| EPA Package | Large Silica Particles | Small Silica Particles | Alumina Oxide Coated Titanium Oxide | Conductive EPA |
| Control 1 | 1.0% | 0.23% | 0.33% | N/A |
| Package 1-1a | 0.7% | 0.23% | 0.33% | 0.3% EC-300T |
| Package 1-1b | 0.4% | 0.23% | 0.33% | 0.6% EC-300T |
| Package 1-2a | 0.7% | 0.23% | 0.33% | 0.3% ET-300W |
| Package 1-2b | 0.4% | 0.23% | 0.33% | 0.6% ET-300W |
| Package 1-3a | 0.7% | 0.23% | 0.33% | 0.3% ES-650 |
| Package 1-3b | 0.4% | 0.23% | 0.33% | 0.6% ES-650 |
| Package 1-4a | 0.7% | 0.23% | 0.33% | 0.3% HSC059SiC |
| Package 1-4b | 0.4% | 0.23% | 0.33% | 0.6% HSC059SiC |

The relatively large silica particles in the above table are Degussa RY-50 hydrophobic, negatively charged silica particles treated with silicone oil having an average primary particle size of about 40 nm and a surface area of about 15 to 45 m$^2$/g. The relatively small silica particles in the above table are Degussa R-812 hydrophobic silica particles treated with HMDS having an average primary particle size of about 7 nm and a surface area of about 260±30 m$^2$/g. The aluminum oxide coated titanium oxide particles are ISK FTL-110 particles having a particle diameter of about 0.13 μm and a particle length of about 1.7 μm. The properties of the conductive additives are summarized below in Table 2.

TABLE 2

| Conductive Additive | Volume Resistivity (Ω-cm) | Material Description | Particle Size (nm) | Supplier |
|---|---|---|---|---|
| EC-300T | 100 | $Sb_2O_5$ doped $SnO_2$ coated titania & Coupling Agent | 60 | Titan KKK |
| ET-300W | 20 | $Sb_2O_5$ doped $SnO_2$ coated titania | 50 | ISK |
| ES-650 | 100 | $Sb_2O_5$ doped $SnO_2$ coated silica | 60 | Titan KKK |
| HSC059SiC | 750 | Silicon Carbide | 600 | Superior Graphite |

Each of the additive packages were combined in a Cyclomix for 60 seconds at 10 Hz and then at 40 Hz for 180 seconds.

The Epping charge of the control toner and toner packages 1-3 was measured. The results of the measurements are illustrated in FIG. 1, which appears to demonstrate that the Epping charge of the toner decreased with the addition of the conductive additives.

Figure 2:
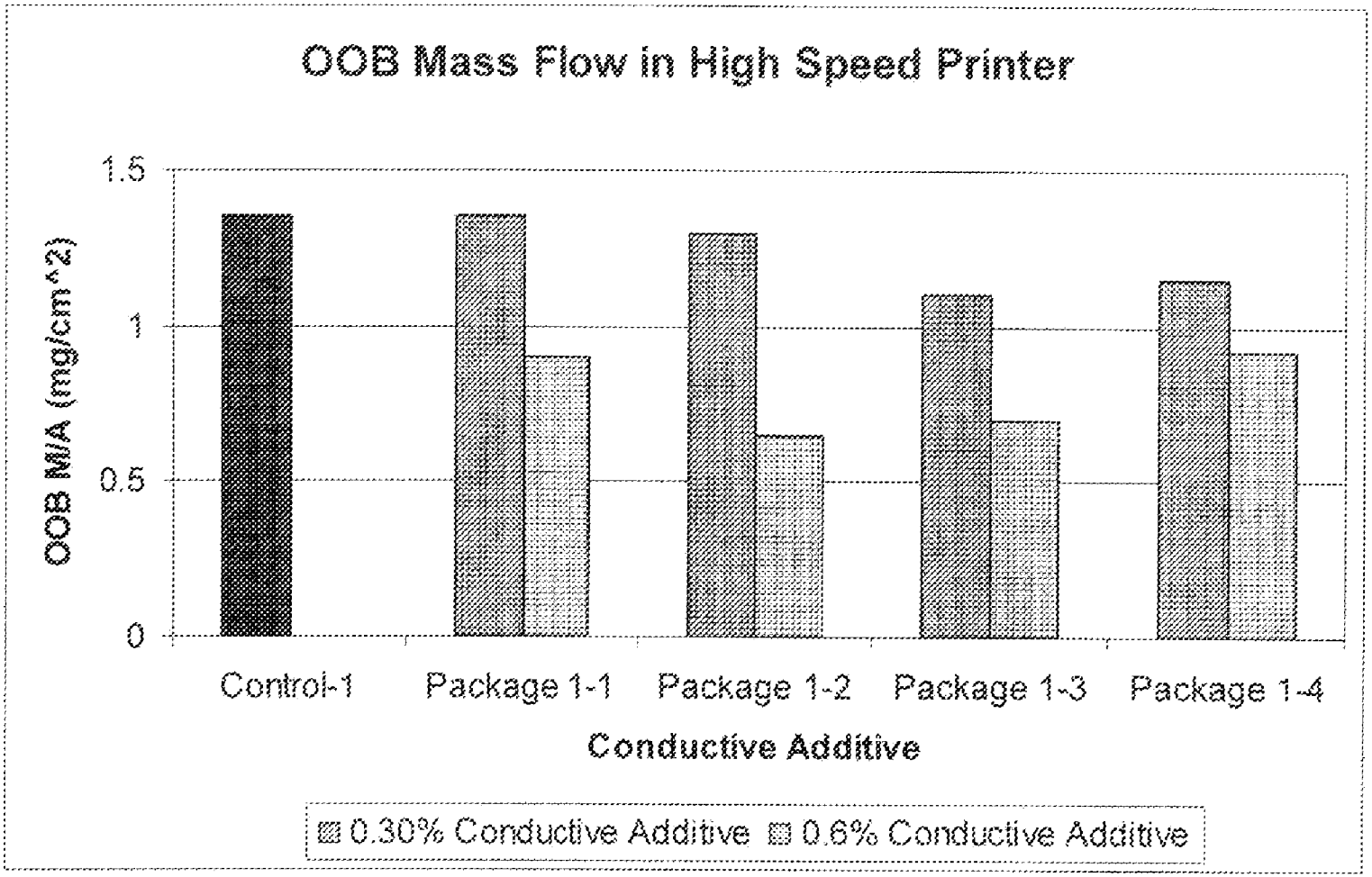
FIG. 2 illustrates the effect of various conductive additives on the Mass Flow of a toner in a high speed printer.
Figure 3:
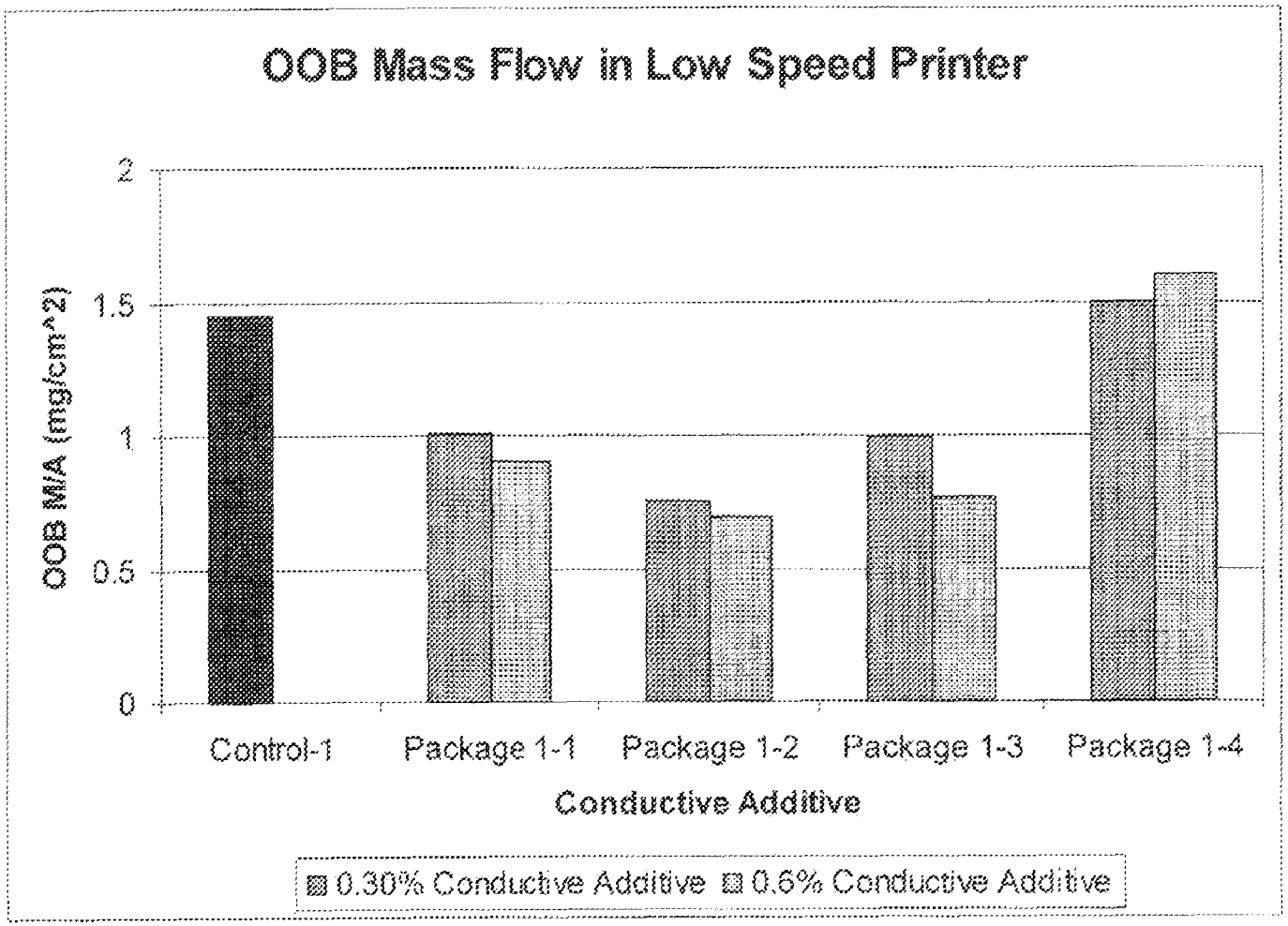
FIG. 3 illustrates the effect of various conductive additives on the Mass Flow of a toner in a low speed printer.

The mass flow was measured for the control package and toner packages 1-4 at high print speeds (i.e., 50 pages per minute) and low print speeds (i.e., 27 pages per minute). The results of the measurements at high print speeds are illustrated in FIG. 2, which demonstrates that the addition of the conductive additives at optimum concentrations reduces the mass flow. In particular the mass flow is reduced to a level in the range of 0.4 to 0.8 mg/cm$^2$ upon the addition of 0.60% conductive additives to the extra particulate packages. The results of the measurements at low print speeds are illustrated in FIG. 3, which similarly demonstrates that the addition of the conductive additives at selected concentrations reduces the mass flow at corresponding print speeds, with the exception of toner package 4 (which contained silicon carbide). In particular, for packages 1-3, the mass flow is reduced to a level in the range of 0.4 to 0.8 mg/cm$^2$ upon the addition of 0.60% conductive additives to the extra particulate packages. Accordingly, it should be appreciated that in some instances, the specific conductive additive chosen may be varied depending on the application or printer in which the conductive additive may be employed.

EXAMPLE 2

A relatively small particle toner having a particle size of approximately 6.5 μm was treated with a number of extra particulate additive packages described below in Table 3, which contain relatively acicular conductive additives.

TABLE 3

| | Extra Particulate Additive Packages | | | |
|---|---|---|---|---|
| | EPA (% by weight of the toner) | | | |
| EPA Package | Large Silica Particles | Small Silica Particles | Alumina Oxide Coated Titanium Oxide | Conductive EPA |
| Control 2 | 1.04% | 0.23% | 0.33% | N/A |
| Package 2-1a | 1.04% | 0.23% | 0.16% | 0.16% FT-1000 |
| Package 2-1b | 1.04% | 0.23% | 0% | 0.33% FT-1000 |
| Package 2-2a | 1.04% | 0.23% | 0.16% | 0.16% FTX-09 |
| Package 2-2b | 1.04% | 0.23% | 0% | 0.33% FTX-09 |
| Package 2-3a | 1.04% | 0.23% | 0.16% | 0.16% FTX-10 |

TABLE 3-continued

| | Extra Particulate Additive Packages | | | |
|---|---|---|---|---|
| | EPA (% by weight of the toner) | | | |
| EPA Package | Large Silica Particles | Small Silica Particles | Alumina Oxide Coated Titanium Oxide | Conductive EPA |
| Package 2-3b | 1.04% | 0.23% | 0% | 0.33% FTX-10 |
| Package 2-4a | 1.04% | 0.23% | 0.16% | 0.16% FTL-100 |
| Package 2-4b | 1.04% | 0.23% | 0% | 0.33% FTL-100 |
| Package 2-5a | 1.04% | 0.23% | 0.16% | 0.16% HSC059SiC |
| Package 2-5b | 1.04% | 0.23% | 0% | 0.33% HSC059SiC |

The relatively large silica particles in the above table are Degussa RY-50 hydrophobic, negatively charged silica particles treated with silicone oil having an average primary particle size of about 40 nm and a surface area of about 15 to 45 m$^2$/g. The relatively small silica particles in the above table are Degussa R-812 hydrophobic silica particles treated with HMDS having an average primary particle size of about 7 nm and a surface area of about 260+/−30 m$^2$/g. The aluminum oxide coated titanium oxide particles are ISK FTL-110 particles having a particle diameter of about 0.13 μm and a particle length of about 1.7 μm. The aluminum oxide coated titanium oxide particles may have a volume resistivity of E8 Ω-cm. The properties of the conductive additives are summarized below in Table 4.

TABLE 4

| Conductive Additive | Volume Resistivity (Ω-cm) | Material Description | Particle Size (nm) | Supplier |
|---|---|---|---|---|
| FTX-10 | 300 | $Sb_2O_5$ doped $SnO_2$ coated acicular titania | 60 | ISK |
| FTX-09 | 30 | $Sb_2O_5$ doped $SnO_2$ coated acicular titania | 50 | ISK |
| FT-1000 | 5 | $Sb_2O_5$ doped $SnO_2$ coated acicular | 60 | ISK |
| FTL-100 | E5 | Acicular titania | 130 × 1,700 | ISK |
| HSC059SiC | 750 | Silicon Carbide | 600 | Superior Graphite |

Each of the additive packages were combined in a Cyclomix for 60 seconds at 10 Hz and then at 40 Hz for 180 seconds.

Figure 4:
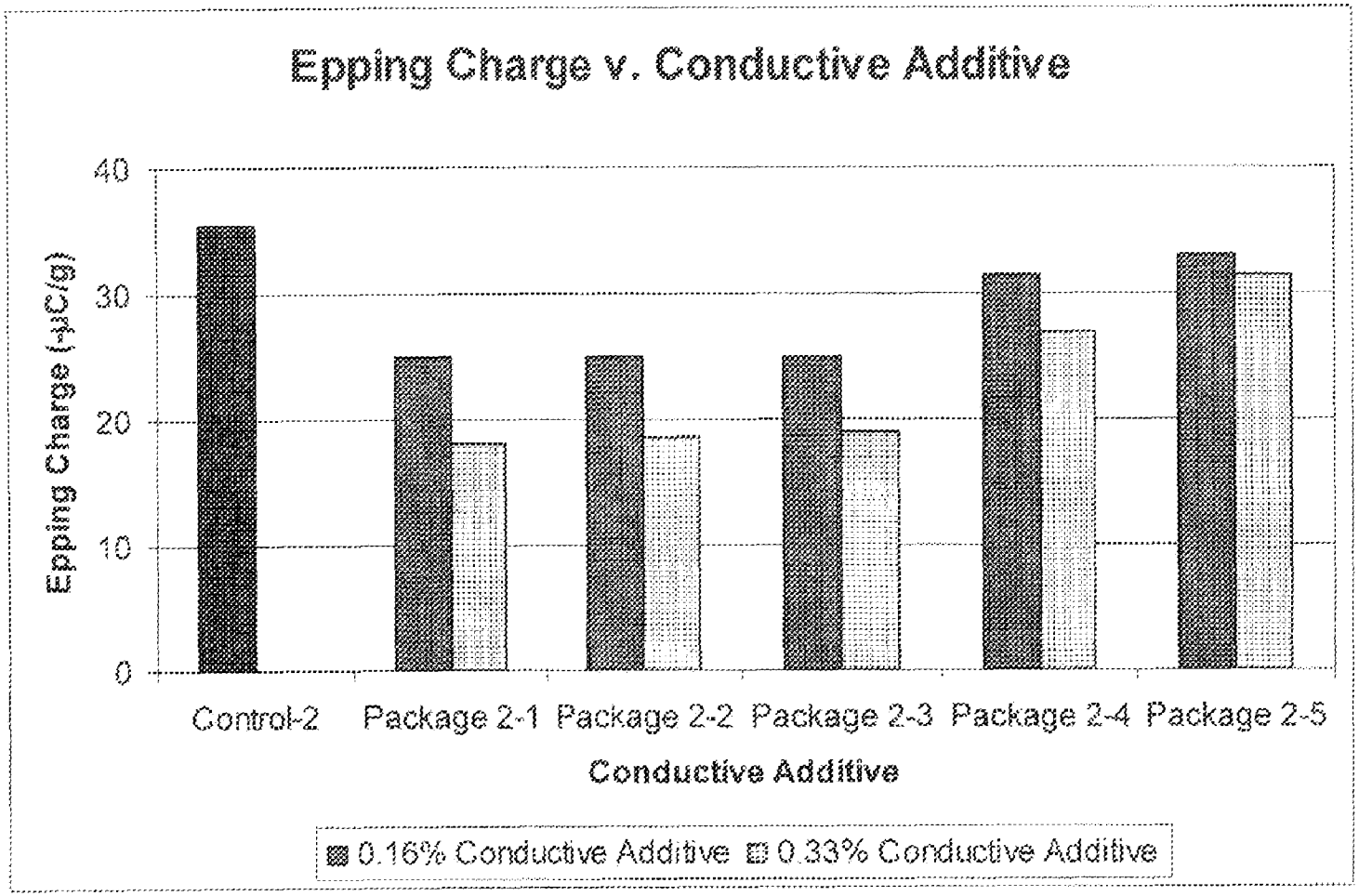
FIG. 4 illustrates the effect of the addition of various conductive additives on the Epping charge of a toner.

The Epping charge of the various toner packages and the control toner package was determined. The results of the measurements are illustrated in FIG. 4, which demonstrates that the Epping charge of the toner decreases with the addition of the conductive additives at selected concentrations.

Figure 5:
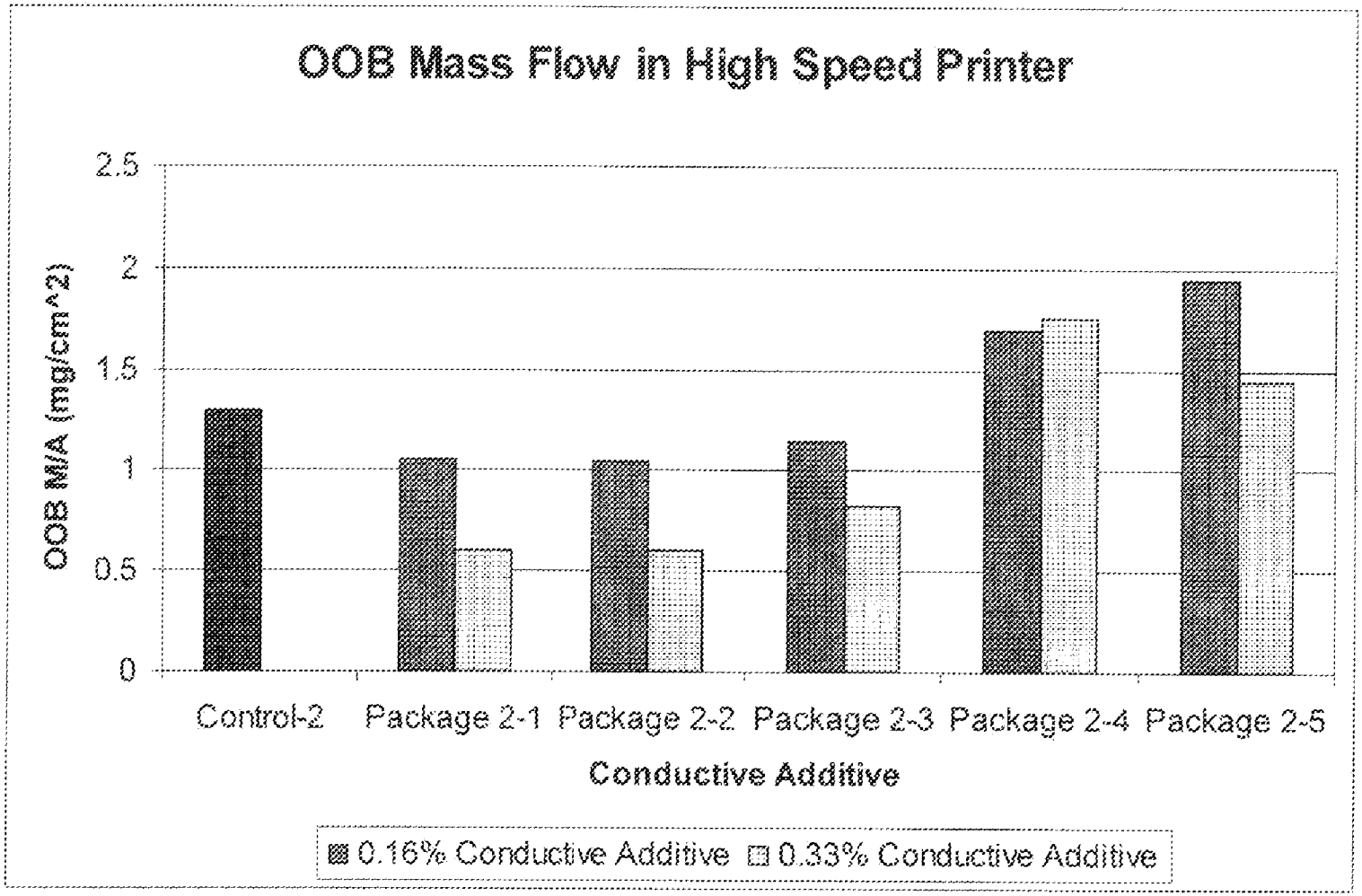
FIG. 5 illustrates the effect of various conductive additives on the Mass Flow of a toner in a high speed printer.
Figure 6:
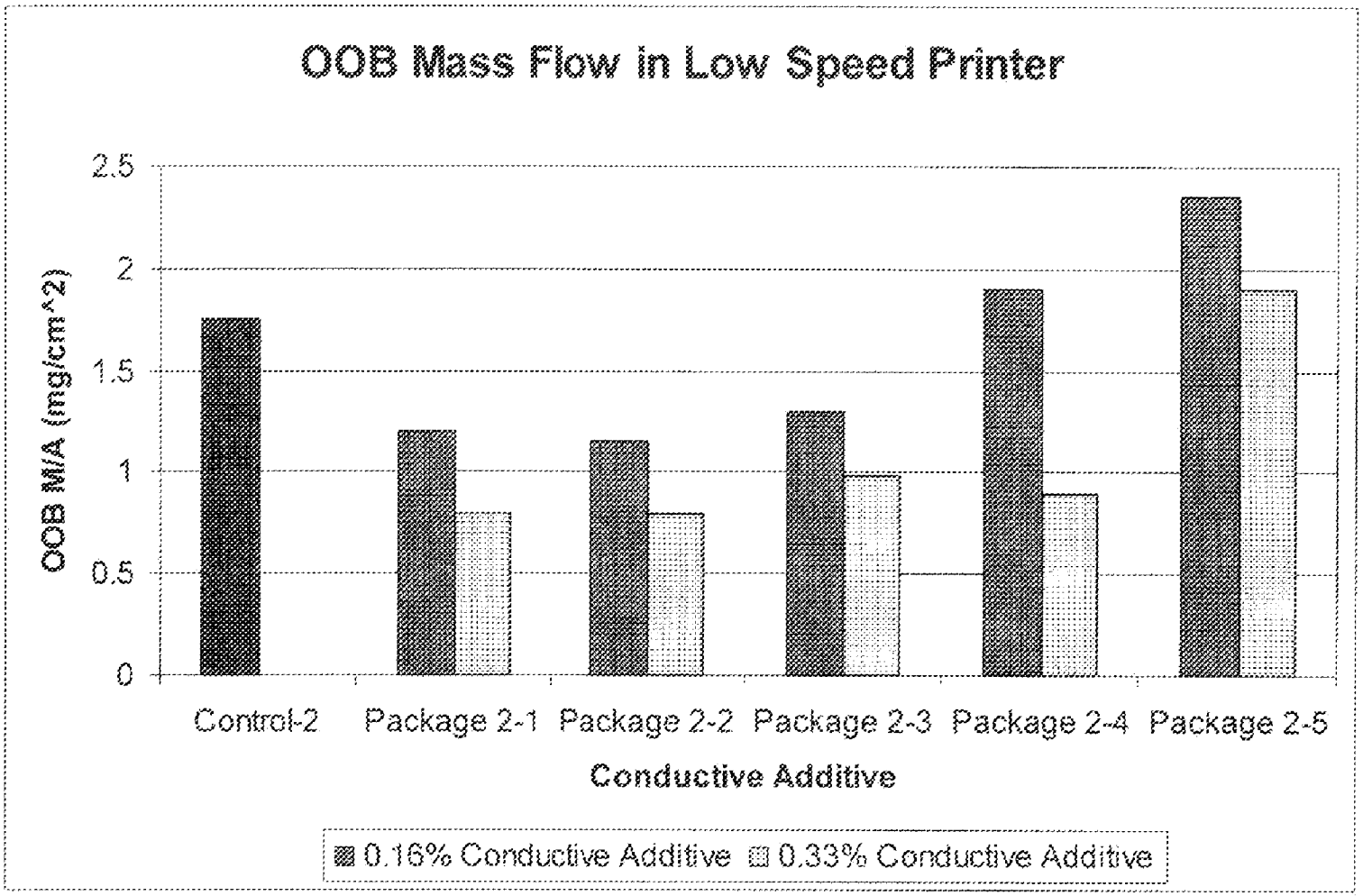
FIG. 6 illustrates the effect of various conductive additives on the Mass Flow of a toner in a low speed printer.
Figure 7:
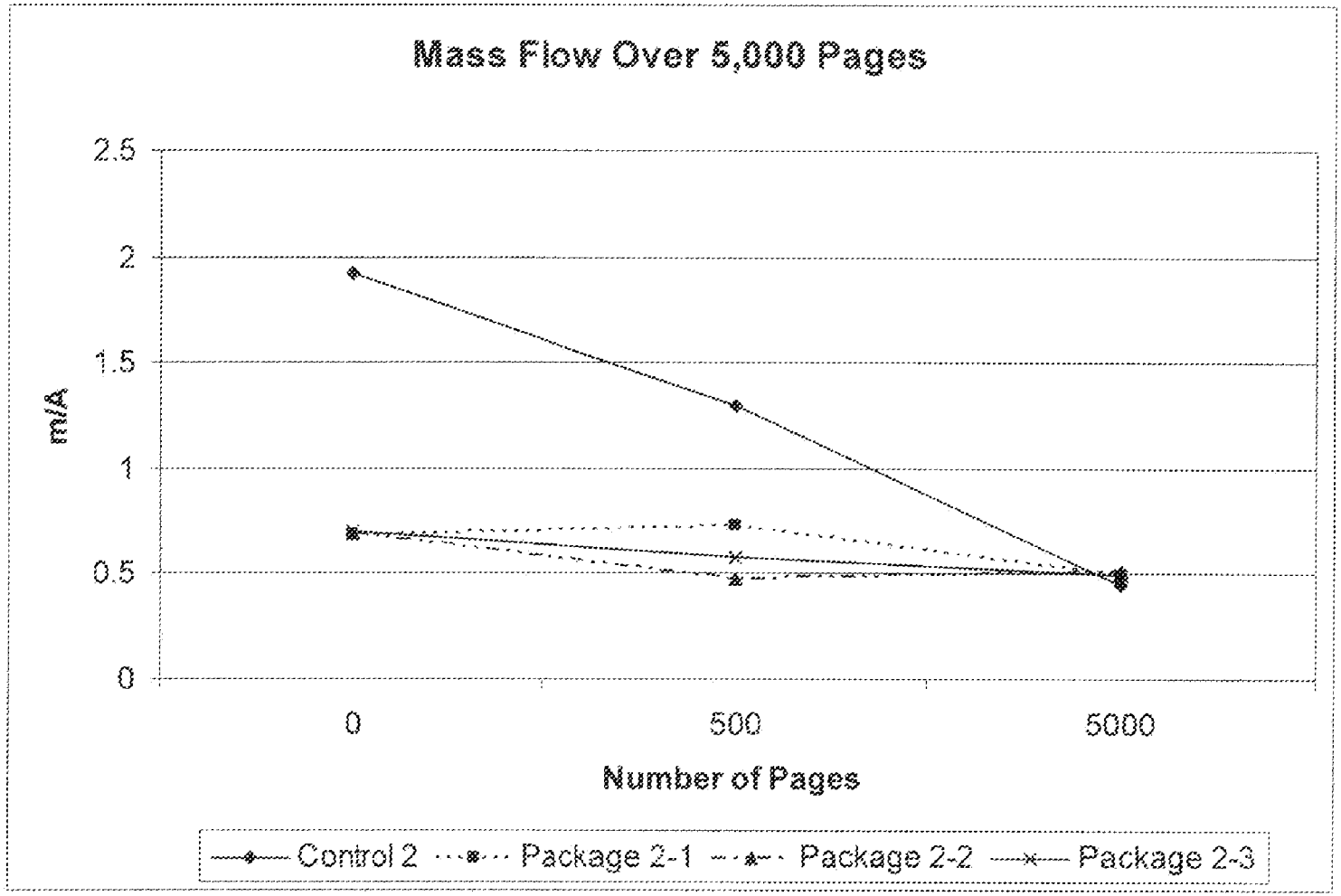
FIG. 7 illustrates the change of Mass Flow over the cycle of a number of pages for toner containing various conductive additives.

The mass flow was measured for the various toner packages and the control toner package at high print speeds (i.e., 50 pages per minute) and low print speeds (i.e., 27 pages per minute). The results of the measurements are illustrated in FIG. 5, which indicates that upon the addition of selected conductive additives at a selected concentration, i.e., FT-1000, FTX-09, FTX-10, the mass flow of the toner decreased. Similarly at low print speeds, as illustrated in FIG. 6, the mass flow of the toner decreased upon the addition of the conductive additives, including the FTL-100. Furthermore, as illustrated in FIG. 7, the mass flow of the particles containing 0.33% conductive additive and 0% alumina oxide coated titanium oxide remained relatively stable over the cycle of 5,000 pages whereas the mass flow of the alumina oxide coated titanium oxide decreased greatly over the 5,000 cycles.

EXAMPLE 3

Two toner formulations were prepared with a relatively small particle toner having a particle size of approximately 7 μm. The first formulation A included three extra particulate additives, while the second formulation B included four extra particulate additives. The formulations are summarized in Table 5 below.

TABLE 5

| Toner Formulations | | | | |
|---|---|---|---|---|
| | EPA (% by weight of the toner) | | | |
| Formulation | Large Silica Particles | Small Silica Particles | Alumina Oxide Coated Titanium Oxide | Conductive EPA |
| A | 0.91% | 0.21% | 0.29% | N/A |
| B | 0.91% | 0.21% | 0.29% | 0.25% ET-300W |

The relatively large silica particles in the above table are Degussa RY-50 hydrophobic, negatively charged silica particles treated with silicone oil having an average primary particle size of about 40 nm and a surface area of about 15 to 45 $m^2/g$. The relatively small silica particles in the above table are Degussa R-812 hydrophobic silica particles treated with HMDS having an average primary particle size of about 7 nm and a surface area of about 260+/−30 $m^2/g$. The aluminum oxide coated titanium oxide particles are ISK FTL-110 particles having a particle diameter of about 0.13 μm and a particle length of about 1.7 μm. The aluminum oxide coated titanium oxide particles may have a volume resistivity of E8 Ω-cm. The conductive additive, ET-300W, as noted above, may be available from ISK and is a $Sb_2O_5$ doped $SnO_2$ titania having a volume resistivity of about 20.

The Epping charge of the formulations was measured. The results of these measurements are illustrated in Table 6 below, which demonstrates that the Epping charge of the toner decreased with the addition of the conductive additive at selected concentrations.

TABLE 6

| Epping Charge | |
|---|---|
| Toner Formulation | Epping Charge (μC/g) |
| A | −32.0 |
| B | −27.0 |

The mass flow and the center to edge ratio of the mass flow of the toner formulations were measured at various environmental conditions and over at least a portion of the life of the cartridge. More specifically, the environmental conditions included ambient temperature, 78° F. at 80 relative humidity and 60° F. at 8% relative humidity. In addition, the measurements were made after the first page or first few pages and after about the 5,000$^{th}$ page. The results of the tests are summarized below in Table 7.

TABLE 7

| Mass Flow | | | | | |
|---|---|---|---|---|---|
| | | Average M/A ($mg/cm^2$) | | Center to Edge Ratio | |
| Environment | Toner ID | 0K | 5K | 0K | 5K |
| Ambient | Formulation A | 0.58 | 0.30 | 0.90 | 0.96 |
| | Formulation B | 0.52 | 0.45 | 0.97 | 1.03 |
| 78/80 | Formulation A | 0.73 | 0.51 | 0.90 | 0.97 |
| | Formulation B | 0.69 | 0.40 | 0.88 | 0.80 |
| 60/08 | Formulation A | 0.53 | 0.53 | 0.93 | 1.03 |
| | Formulation B | 0.58 | 0.42 | 1.02 | 1.00 |

The target range for the mass flow was set between about 0.4 to about 0.6 $mg/cm^2$. As can be seen from the above, at ambient temperatures, the mass flow of formulation B containing the conductive particle remained within the target range during the cartridge life. At high temperature and humidity conditions and a low page count, the mass flow of both formulations were outside the target window, however formulation B still performed better than formulation A. At high temperature and humidity conditions and at a high page count, the mass flow remained within the target window for both formulations. At lower temperature and humidity conditions, the mass flow remained in the target window for both formulations throughout the tested cartridge life. This does not, however, discount the ability to control mass flow with conductive additive at ambient and typical operating conditions.

With respect to the center to edge ratio, the optimum value approaches one, signifying uniform toner coverage. As can be seen from Table 7, formulation B exhibits a ratio that is closest to one at ambient conditions. At high temperature and humidity conditions, the formulation without conductive agent appears to perform better. However at low temperature and humidity conditions, formulation B appears to have performed better, indicating that formulation B has a greater operating window with respect to temperature and humidity.

In addition to the Epping charge and Mass flow, print uniformity was quantified over the length of a given page. This may be measure by quantifying the percentage change in L* (ΔL*), which indicates the lightness of a color, wherein L*=0 is black and L*=100 is white. Table 8 summarizes the results of the measurement.

TABLE 8

| Environment | Toner Formulation | ΔL* (%) |
|---|---|---|
| | ΔL* (%) | |
| Ambient | Formulation A | −3.0 |
| | Formulation B | <1.0 |
| 78/80 | Formulation A | −1.5 |
| | Formulation B | <1.0 |
| 60/08 | Formulation A | −2.5 |
| | Formulation B | <1.0 |

As can be seen from the above table, the ΔL* (%) change over the length of a given page remained less than 1.0 for Formulation B containing the conductive additive for all environmental conditions.

Figure 8:
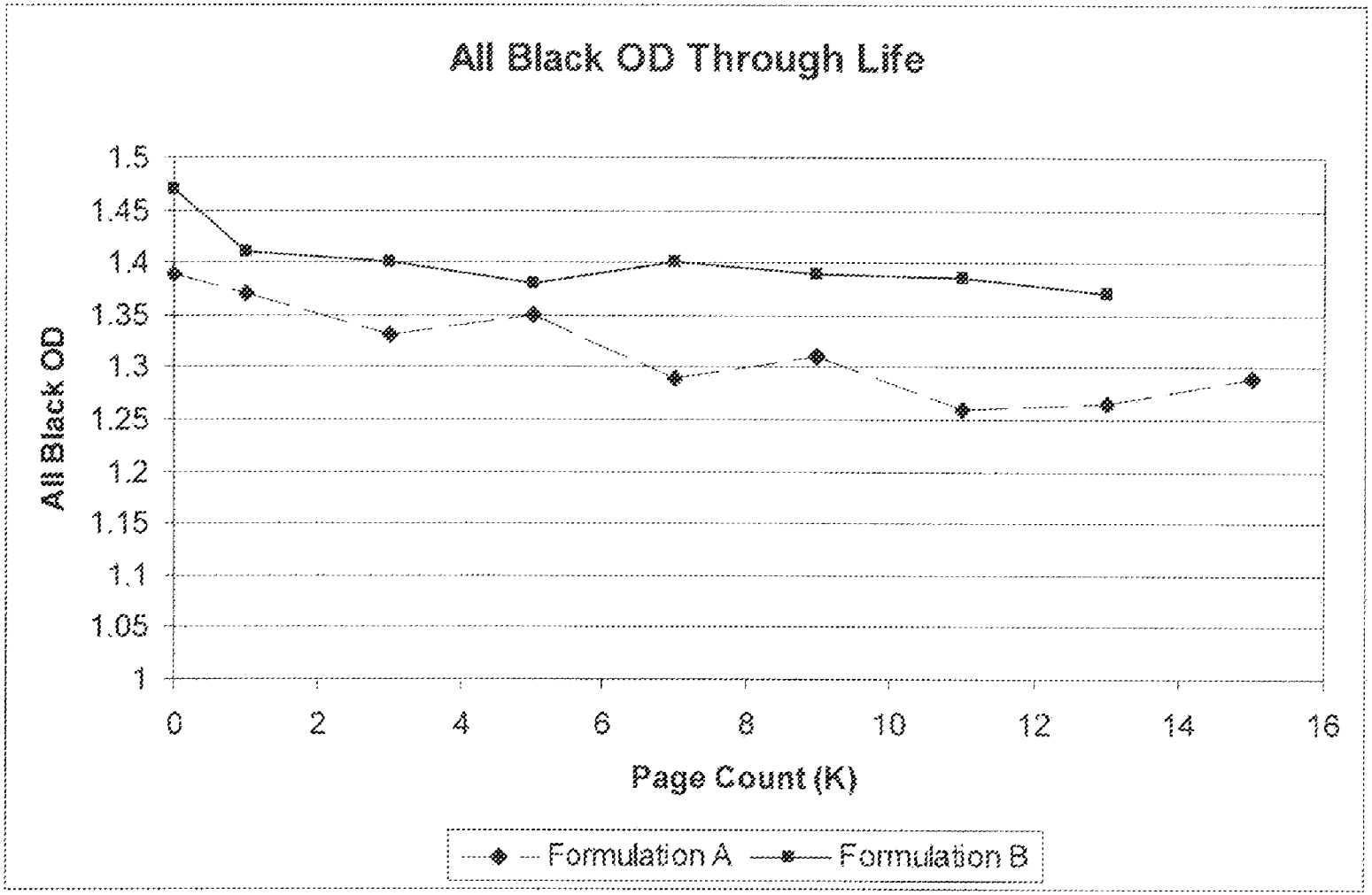
FIG. 8 illustrates the change in optical density of a toner formulation with a conductive additive added and a toner formulation without a conductive additive.

Furthermore, the optical density or absorbance of an all black page at a density of eight was measured for every 2,000 pages. The results of this test are summarized in FIG. 8 which appears to illustrate that the optical density of formulation B remained stable over the measured life of the cartridge.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A toner composition comprising:

toner particles having a size of about 1-25 μm;

silica particles having an average diameter $D_1$ and an average diameter $D_2$ wherein $D_1<D_2$;

alumina coated titania particles having a particle diameter of 0.1 μm to 1 μm; and conductive additive having a volume resistivity in the range of about $E^{-6}$ to $E^{6}$ ohm-cm wherein said conductive additive is present at a concentration to provide a mass flow of about 0.2 to 1.5 mg/cm$^2$.

2. The conductive additive of claim 1 at a concentration of about 0.01 to 5.0% by weight of the toner.

3. The toner composition of claim 1 wherein said silica particles having a diameter of $D_1$ are present at a concentration that is less than the concentration of said silica particles having a diameter of $D_2$.

4. The toner composition of claim 1 wherein said silica particles having a diameter $D_1$ are present at a concentration of about 0.1-0.5% by weight of toner.

5. The toner composition of claim 1 wherein said silica particles having a diameter $D_2$ are present at a concentration of about 0.1-1.5% by weight of toner.

6. The toner composition of claim 1 wherein said alumina coated titania particles are present in the range of about 0.1 to 0.5% by weight of the toner.

7. The toner composition of claim 1 wherein said alumina coated titania particles are present in the range of about 0.1 to about 0.5% by weight of the toner, said silica particles having a diameter $D_1$ are present in the range of about 0.1 to 0.5% by weight of the toner, said silica particles having a diameter $D_2$ are present in the range of about 0.1 to 1.5% by weight of the toner, and said conductive additives are present in the range of about 0.1 to 0.8% by weight of the toner.

8. The toner composition of claim 1 wherein conductive additive comprises antimony oxide doped tin oxide coated titania or antimony oxide/tin oxide coated silica.

9. The toner composition of claim 1 wherein said conductive additives is an acicular antimony oxide doped tin oxide coated titania.

10. The toner composition of claim 1 wherein said conductive additive is a substantially spherical antimony oxide doped tin oxide particle.

11. The toner composition of claim 1 wherein said conductive additive has a particle size of about 5 nm-2000 nm.

12. The toner composition of claim 1 wherein said toner exhibits a mass flow of about 0.4 to 0.8 mg/cm$^2$.

13. A method for controlling the mass flow of toner having particle size of about 1-25 μm comprising:

mixing said toner with silica particles having a diameter $D_1$, silica particles having a diameter $D_2$, alumina coated titania particles having a particle diameter of 0.1 μm to 1 μm, and a conductive additive, wherein said conductive additive has a volume resistivity in the range of about $E^{-6}$ to $E^{6}$ ohm-cm and wherein said conductive additive is combined with said toner at a concentration to provide a mass flow of about 0.2 to 1.5 mg/cm$^2$.

14. The method of claim 13 wherein said conductive additive is in the range of about 0.01 to 5.0% by weight of the toner.

15. The method of claim 13 further comprising mixing said toner with silica particles having an average diameter $D_1$ and an average diameter $D_2$ wherein $D_1<D_2$.

16. The method of claim 15 wherein said silica particles having a diameter of $D_1$ are present at a concentration that is less than the concentration of said silica particles having a diameter of $D_2$.

17. The method of claim 13 wherein said silica particles having a diameter $D_1$ are present at a concentration of about 0.1-0.5% by weight of toner.

18. The method of claim 13 wherein said silica particles having a diameter $D_2$ are present at a concentration of about 0.1-1.5% by weight of toner.

19. The method of claim 13 wherein said alumina coated titania particles are present in the range of about 0.1 to 0.5% by weight of the toner.

20. The method of claim 13 wherein said silica particles having a diameter $D_1$ are present in the range of about 0.1 to 0.5% by weight of the toner, said silica particles having a diameter $D_2$ are present in the range of about 0.1 to 1.5% by weight of the toner, said alumina coated titania particles are present in the range of about 0.1 to about 0.5% by weight of the toner and said conductive additives are present in the range of about 0.1 to 0.8% by weight of the toner.

21. The method of claim 13 wherein conductive additive comprises antimony oxide doped tin oxide coated titania or antimony oxide/tin oxide coated silica.

22. The method of claim 13 wherein said conductive additives is an acicular antimony oxide doped tin oxide coated titania.

23. The method of claim 13 wherein said conductive additive is a substantially spherical antimony oxide doped tin oxide particle.

24. The method of claim 13 wherein said mass flow is about 0.2 to 1.5 mg/cm$^2$.

* * * * *